United States Patent [19]

D'Angelo

[11] Patent Number: 4,784,385

[45] Date of Patent: Nov. 15, 1988

[54] AQUATIC EXERCISING DEVICE

[76] Inventor: Joseph M. D'Angelo, 2835 Bottlebrush Dr., Los Angeles, Calif. 90077

[21] Appl. No.: 17,212

[22] Filed: Feb. 20, 1987

[51] Int. Cl.[4] ..... A63B 21/00

[52] U.S. Cl. ..... 272/130; 272/116

[58] Field of Search ..... 272/1 B, 63, 71, 116, 272/128, 130, 132, DIG. 4, 134

[56] References Cited

U.S. PATENT DOCUMENTS

| | | | |
|---|---|---|---|
| 618,990 | 2/1899 | Lubben | 272/116 |
| 1,279,633 | 9/1918 | Allen | 272/116 |
| 3,721,438 | 3/1973 | Kusmer | 272/132 X |
| 4,249,725 | 2/1981 | Mattox | 272/130 X |
| 4,661,807 | 9/1986 | Castillo | 272/132 |

FOREIGN PATENT DOCUMENTS

| | | | |
|---|---|---|---|
| 446148 | 3/1968 | Switzerland | 272/134 |
| 25560 | of 1908 | United Kingdom | 272/128 |
| 2163358 | 2/1986 | United Kingdom | 272/134 |

*Primary Examiner*—Richard J. Apley
*Assistant Examiner*—Robert D. Bahr
*Attorney, Agent, or Firm*—Lyon & Lyon

[57] ABSTRACT

A variable resistance underwater exercising device for working the muscles of the upper body in a cool environment to stimulate generation of body heat. The device includes a support structure, a pair of support arms adjustably mounted on the support structure and a pair of disc assemblies adjustably mounted on the support structure and a pair of disc assemblies adjustably mounted on the support arms. Each of the disc assemblies includes a flat disc, a handle for manually rotating the disc thereby providing exercise to the upper body muscles, a plurality of flat blades carried by the disc and rotatable therewith to provide resistance to rotation in the water, a shroud assembly surrounding the blades and a gearing assembly for collectively varying the angular orientation of the blades with respect to the disc such that resistance of the water against the blades is adjustable to provide the desired drag on the discs as they are manually rotated under water by the user.

11 Claims, 5 Drawing Sheets

AQUATIC EXERCISING DEVICE

BACKGROUND OF THE INVENTION

Recent years have seen an increasing awareness of the benefits of physical exercise and a greater understanding of the human body and its reaction to varying conditions, including coldwater immersion. As a result of our awareness of the benefits of physical exercise, exercising devices of numerous configurations have been developed to provide improved means for systematically exercising and developing different muscles and muscle groups. These devices are almost exclusively designed for use in open air and accordingly, do not take advantage of our improved understanding of the body's reaction to a cold environment to improve caloric consumption. While some exercises and exercising devices have been developed for use in water they are generally designed to alleviate the stress on one's joints created by excessive jarring, torque and torsion which often result from land or open air exercise. Such devices are not concerned with the temperature effects which can be created through water exercise and are largely of the paddle type, designed to simulate the use of barbells on land. Examples of such devices are seen in U.S. Pat. Nos. 4,311,306 4,411,422, 4,416,451 and 4,521,011.

When the human body is immersed in cool water, heat is generated to counter the cooling effect of the water. This heat is then dissipated by convection and conduction resulting in caloric consumption. The toxic effects of immersion in cold water for long periods are now well-known. However, by providing a controlled exercise in cool water of below about 75 degrees Fahrenheit, the increased caloric consumption is highly beneficial and the toxic effects of cold water immersion are avoided.

When exercising in air, the heat generated by the body is largely retained at the skin level and heat evacuation depends on convection across the secreted sweat resulting in a loss of body fluids and salt. When exercising in cool water, these losses are prevented and the caloric consumption increased. This has been found not only to improve the quality of the exercise but may well have long term benefits by increasing the body's metabolism.

The exercising device disclosed herein provides a thorough aerobic exercising of the upper body muscles in a cool water medium. The device also employs a variable resistance load for varying degrees of difficulty without the need for pulleys, cables and/or chains which are ill-suited for underwater use. By being specifically designed for use in water, this exercising device takes full advantage of the cooling properties of the water environment to provide a superior workout and additionally makes exercise in a warm weather environment a more pleasant and attractive venture.

SUMMARY OF THE INVENTION

Briefly, the present invention comprises an underwater exercising device for working the upper body muscles and includes a pair of rotatable discs adjustably mounted on a support frame such that the elevation and orientation of the axes of rotation of the discs can be varied. Each disc carries a variable pitch blade assembly, means for adjusting the pitch of the blades and a handle member mounted adjacent the perimeter of the disc for manually rotating the disc and blade assembly in the water. By changing the pitch of the blades, the resistance of the water against the rotating blades is varied thereby varying the drag on the disc handles and the degree of difficulty of the exercise. By varying the orientation of the axes of rotation of the disc on the frame, different muscles and/or subgroups of muscles are exercised by the underwater rotation of the discs.

It is the primary object of the present invention to provide an exercising device which utilizes the beneficial metabolic effects of exercising in cool water.

It is another object of the present invention to provide an improved exercising device for exercising the upper body muscles.

It is a further object of the present invention to provide an alternative to exercise in hot and/or humid climates where heat accumulation adversely limits the quality, duration and frequency of exercise sessions.

It is a still a further object of the present invention to provide an underwater exercising device for exercising the upper body muscles which provides a variable resistance for the user and is of simple construction and economical to manufacture.

It is yet another object of the present invention to provide a variable resistance exercising device which eliminates the need for pulleys, cables and chains for use underwater.

These and other objects and advantages of the present invention will be readily apparent from the following detailed description taken in conjunction with the accompanying drawings.

IN THE DRAWINGS

DESCRIPTION OF THE PREFERRED EMBODIMENT

Figure 1:
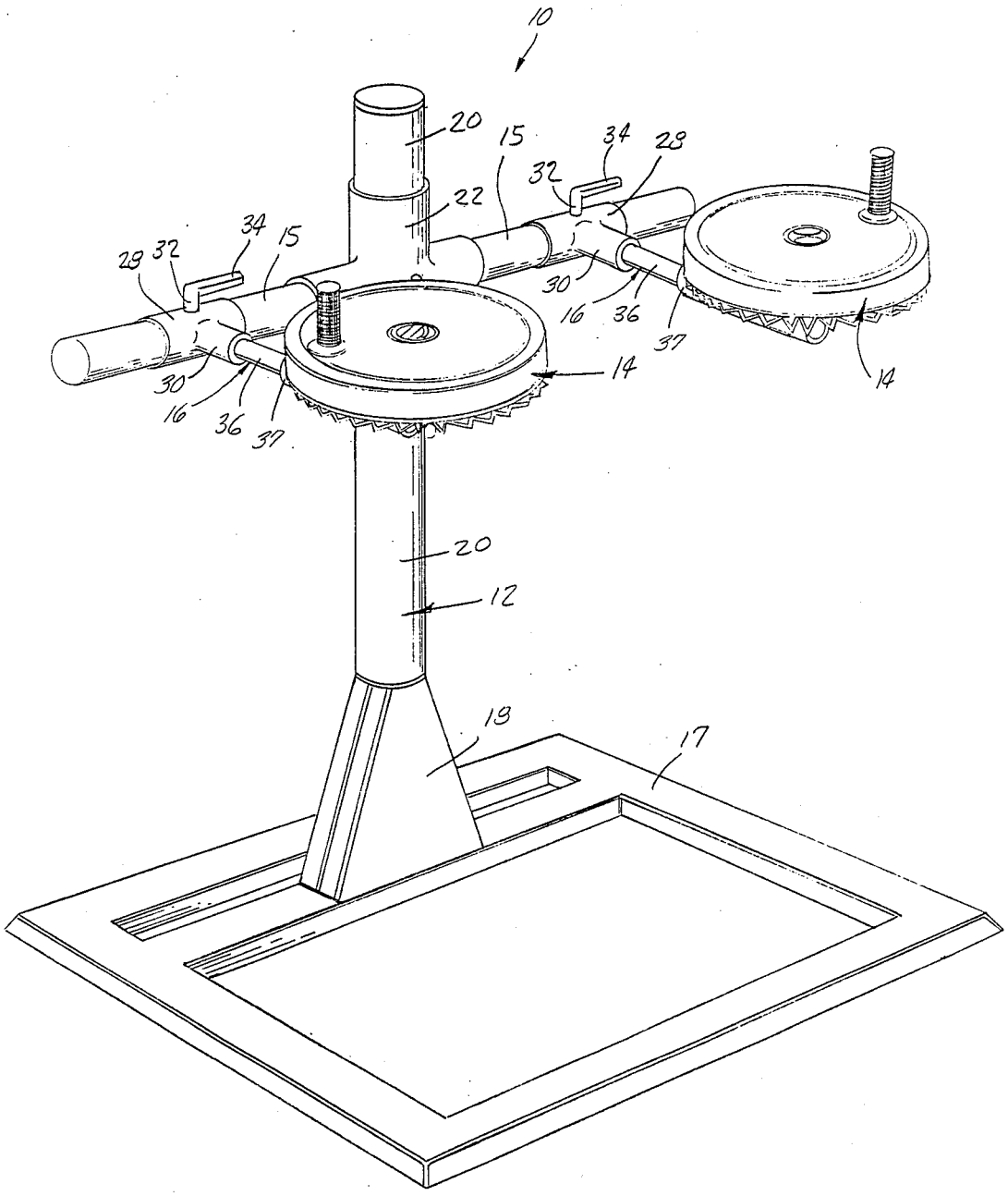
FIG. 1 is a perspective view of the exercising device of the present invention illustrating the axes of rotation of the disc assemblies in a vertical disposition.

Referring now to the detail in drawings, the underwater exercising device 10 of the present invention comprises a support frame 12, a pair of disc assemblies 14 and a pair of adjustable disc assembly supporting arms 16 for positioning the disc assemblies relative to the frame. The support frame 12 includes a pair of horizontal support bars 15, a horizontally disposed base member 17 adapted to rest on the bottom of the pool (not shown) and a support bracket 18 secured to and extending upwardly from the base member 17 to support a vertical upstanding support member 20.

The horizontal support bars 15 are mounted on the support member 20 by a suitable bracket 22 which is slidably disposed thereon. A bolt member 24 is threadedly engaged in bracket 22 for abutment with the support member 20 for locking the bracket 22 in place on the support member thereby fixing the support bars 15 at a desired height. Bolt member 24 is preferably provided with a handle portion 26 to facilitate loosening and tightening thereof.

The disc assembly supporting arms 16 are mounted on the horizontal bars 15 by means of T-couplings 28 which are slidably mounted on bars 15 and have sleeve portions 30 projecting therefrom which receive and support the disc assembly supporting arms 16. Bolt members 32 are provided for threaded engagement with couplings 28 and abutment with bars 15 for securing the couplings 28 in place on bars 15 and providing the desired lateral spacing between the disc assembly supporting arms 16. Both members 32 are preferably provided with handle portions 34 to facilitate loosening and tightening thereof.

In the embodiment shown in the drawings, supporting arms 16 are comprised of extension rods 36 and sleeves 37. Extension rods 36 are rigidly affixed to and project from the sleeve portions 30 of couplings 28 and extend into the open ends 38 of sleeves 37. Bolt members 40, preferably provided with handle portions 42, extend through and threadable engage sleeves 37 for abutment with extension rods 36 to sleeves 37 at the desired length of extension and angular orientation such that the disc assemblies 14 can be secured in either of the two positions illustrated in FIGS. 1 and 2 or any desired angular orientation there between.

Figure 2:
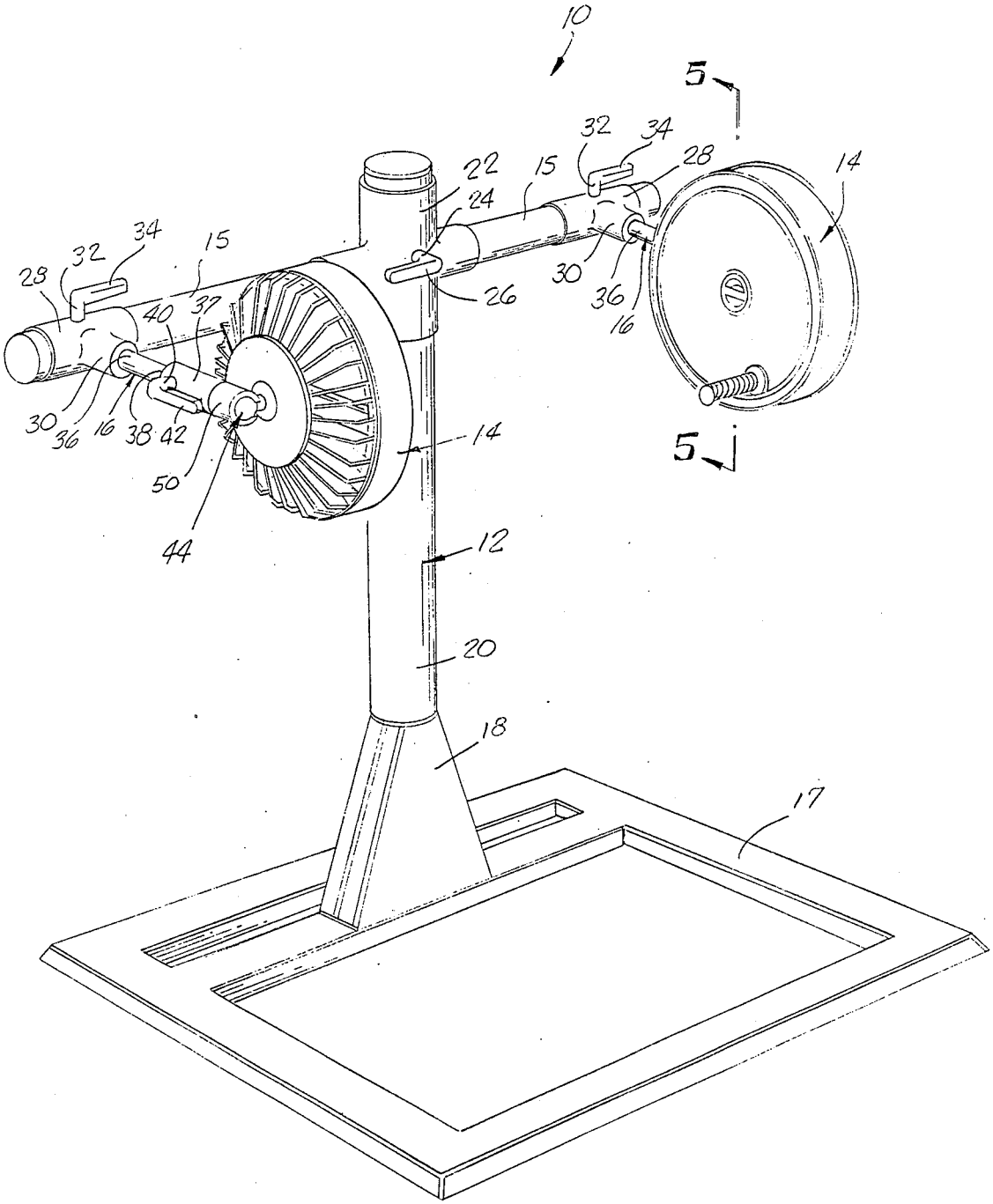
FIG. 2 is a perspective view of the supporting arms and disc assemblies of the present invention illustrating the axes of rotation of the disc assemblies in a horizontal disposition.
Figure 3:
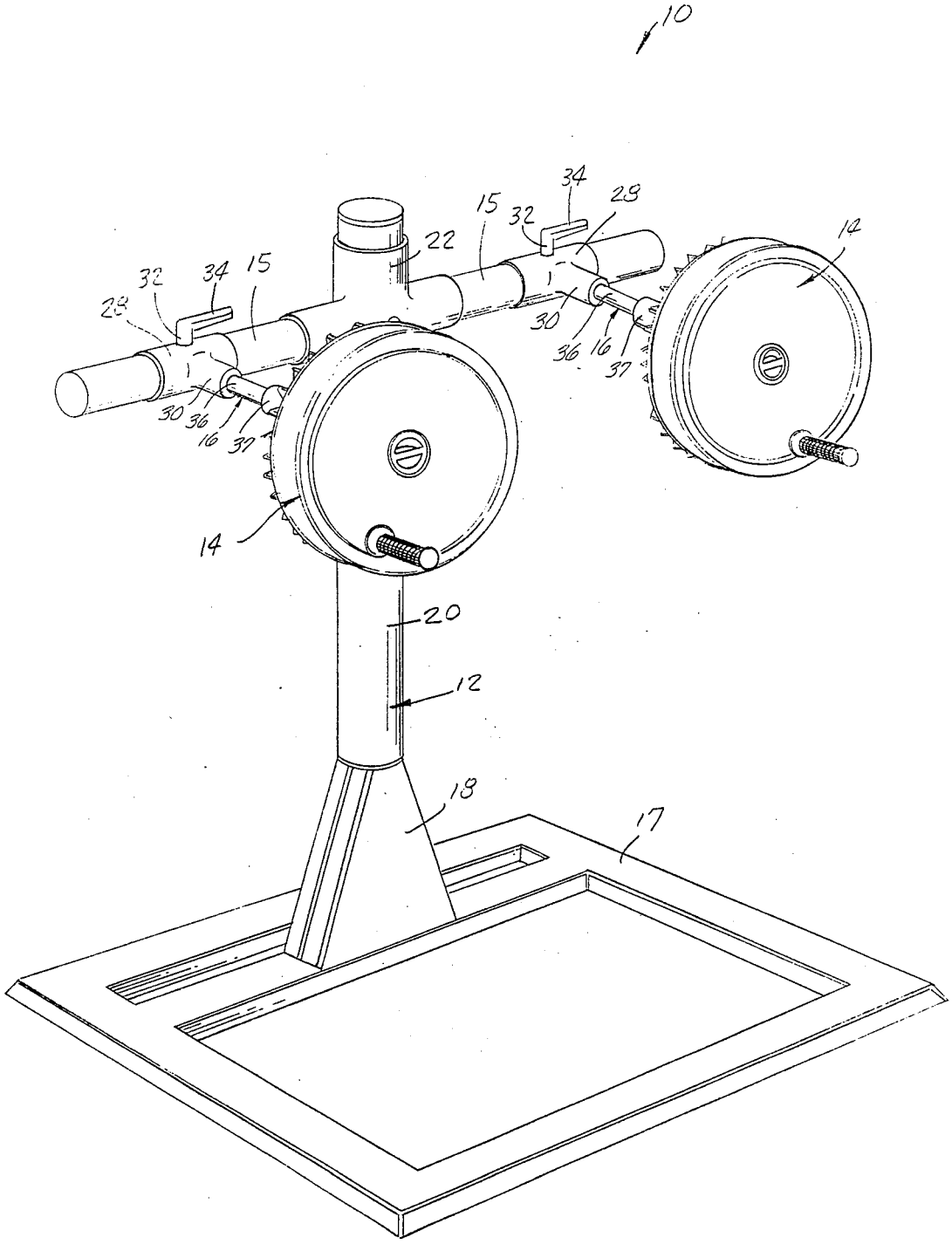
FIG. 3 is a perspective view of the supporting arms and disc assemblies of the present invention illustrating the axes of rotation of the disc assemblies in a second horizontal disposition.
Figure 6:
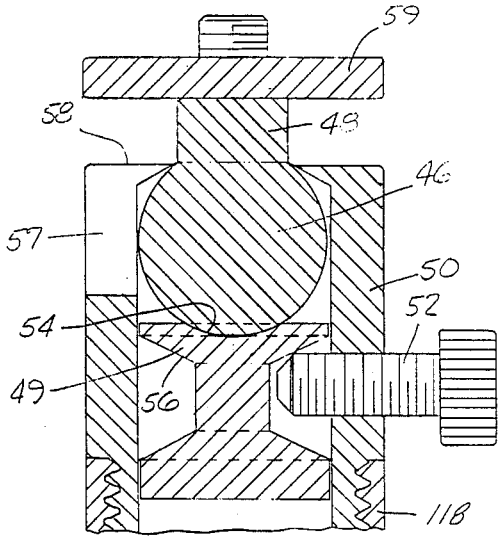
FIG. 6 is a sectional view of the balljoint employed for adjustable securement of the disc assemblies in the second invention.

The disc assemblies 14 are secured to the sleeve portions 37 of supporting arms 16 by ball joints 44. Joints 44 comprise a sphere, 46, a neck portion 48 affixed to and projecting from the sphere 46, a sphere abutment member 49, housing 50 and locking bolt 52. Ball joints 44 are secured to the extended ends of sleeves 37 by threadably engaging housings 50 with the extended ends of sleeves 37. As seen in FIG. 6, the sphere 46 and sphere locking member 49 are adjacently disposed within the housing. The sphere locking member is provided with a concave abutment surface 54 adjacent sphere 46 and a rearwardly disposed tapered surface 56 such that when the locking bolt 52 which extends through and thereby engages housing 50 is tightened, the extended end thereof bears against the inclined surface 56 on the locking member, forcing the concave abutment surface 54 thereof against sphere 46 securign the sphere in place within the housing 50. Housing 50 has a slot 57 therein communicating with the forward end 58 thereof adjacent sphere 46 to accommodate the neck portion which can project axially from the housing 50 or at right angles thereto. Neck portion 48 is rigidly secured to a disc member 59 which in turn is rigidly affixed to the bottom plate 72 of the disc assembly 14. By varying the angular orientation of the neck portions 48 projecting from housings 50, the orientation of the disc assemblies 14 can be varied between that of FIGS. 1 and 2 and that of FIG. 3.

Figure 4:
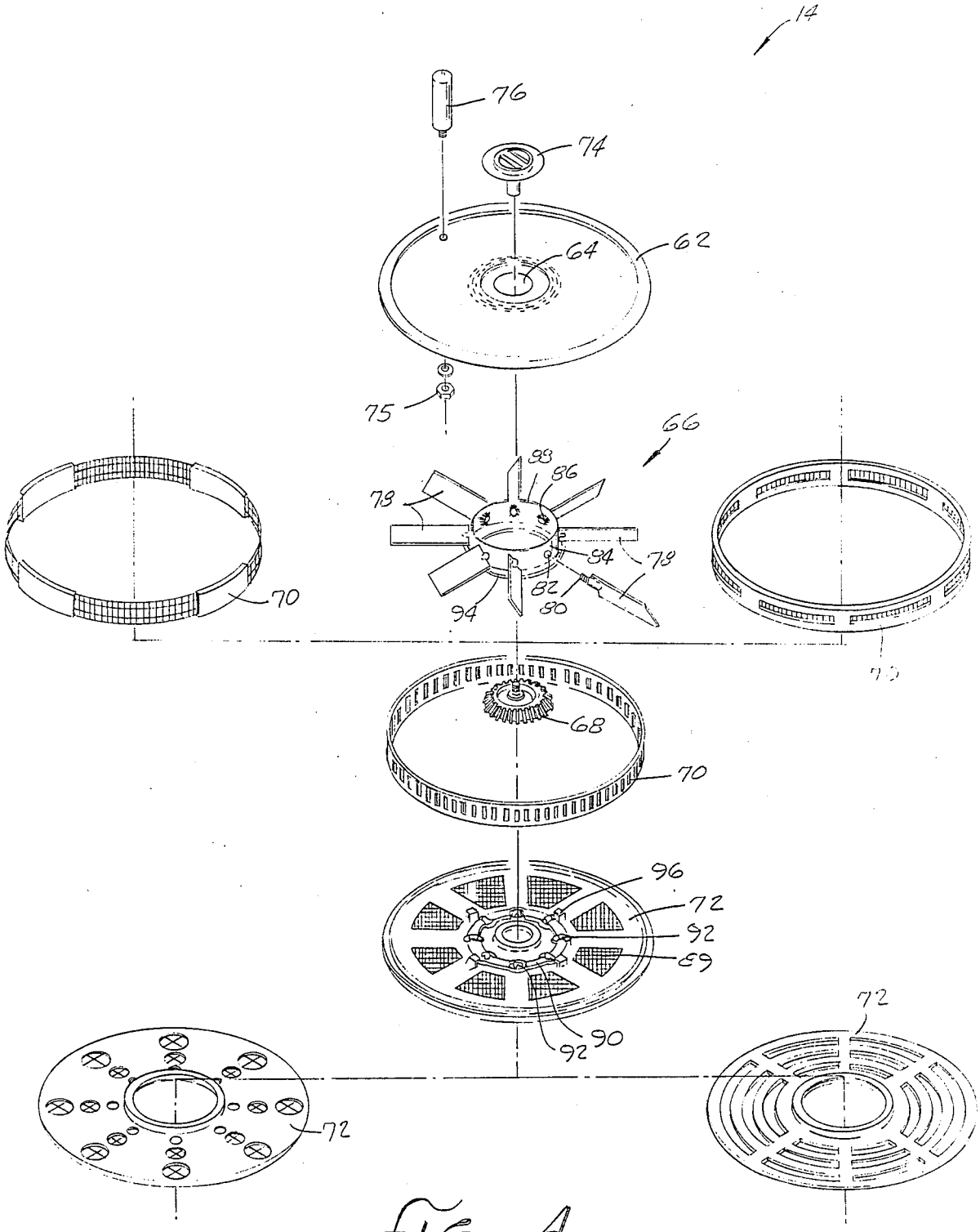
FIG. 4 is an exploded perspective view of the disc assembly of the present invention.
Figure 5:
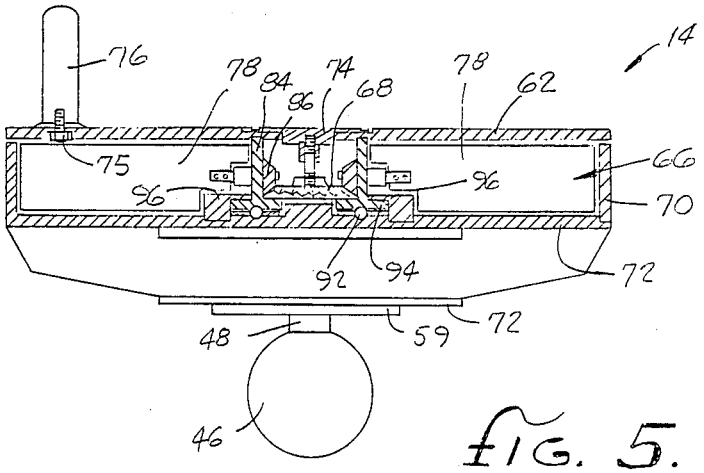
FIG. 5 is a sectional view taken along line 5—5 in FIG. 2.

As seen in FIGS. 4 and 5, the disc assemblies 14 comprise a flat rotatable disc 62 having a central aperture 64 extending there through, a blade assembly 66, master bevel gear 68, annular apertures support wall 70, bottom plate 72 adjustment knob 74 and handle 76. Handle 76 is secured to the disc 62 adjacent the perimeter thereof by a nut member 75. The blade assembly 66 comprises a plurality of flat paddle-like blades 78 terminating at their inner ends in threaded shafts 80 which extend through apertures 82 in the cylindrical wall 84 of the blade assembly and engage the secondary beveled gears 86. The upper circular edge 88 of the cylindrical wall 84 is rigidly affixed to the underside of disc 62. The master beveled gear 68 is in threaded engagement with adjustment knob 74 and meshes with the secondary beveled gears 86 such that rotation of the adjustment knob 74 causes corresponding rotation of the master beveled gear 68 and secondary gears 86 thereby collectively varying the pitch of blades 78 with respect to disc 62.

The bottom plate 72 defines a plurality of openings 89 therein for the passage of water there through and an annular race 90 with bearings 92 therein which abut an annular radial flange 94 extending about the lower edge of the central cylindrical wall 84 of the blade assembly 66. Tabs 96 adjacent race 90 and carried by bottom plate 72 extend over the annular radial flange 94 to secure the bottom plate 72 to the blade assembly 66 while allowing for rotation of the blade assembly with respect to the bottom plate. The annular support wall 70 extends between the perimeter portions of disc 62 and bottom plate 72 and about the blade assembly 66 so as to define a protective shroud about the blades 78. So secured, the disc 62 and blade assembly 66 can be rotated with respect to the remainder of the disc assembly 14 by handle 76.

In use, the exercising device 10 is placed underwater in a pool or the like, wherein the water is preferably less than 75 Fahrenheit. The elevation of the disc assembly supporting arms 16 is adjusted by the user by adjusting the height of bracket 22 on support member 20. The arms 16 are then brought into one of the positions illustrated in FIGS. 1 or 2 by loosening bolt members 40, rotating the extension rods 36 projecting from sleeves 37 to the desired orientation and retightening the bolt members 40 to secure the rods in place. The lateral spacing between the disc assemblies 14 can then be adjusted by means of bolt members 32 and T-couplings 28. The user then adjusts the drag or resistance by changing the pitch of the blades 78 by menas of knob 74. The device is then operated by manual rotation of the disc by means of handles 76 while the user stands on the base portion 17 of the support frame 12.

With the discs aligned for rotation about a vertical axes as seen in FIG. 1, rotation of disc 62 exercises the user's rotator cuff muscles, pectoralis muscles, biceps, triceps, all of the forarm muscles and the deltoids. Using the device 10 in the positions illustrated in FIGS. 2 and 3 exercise many of the same muscles but different fibers and subgroups thereof. With the disc assemblies in the position illustrated in FIG. 3, one also exercises the upper trapezius muscles.

Figure 7:
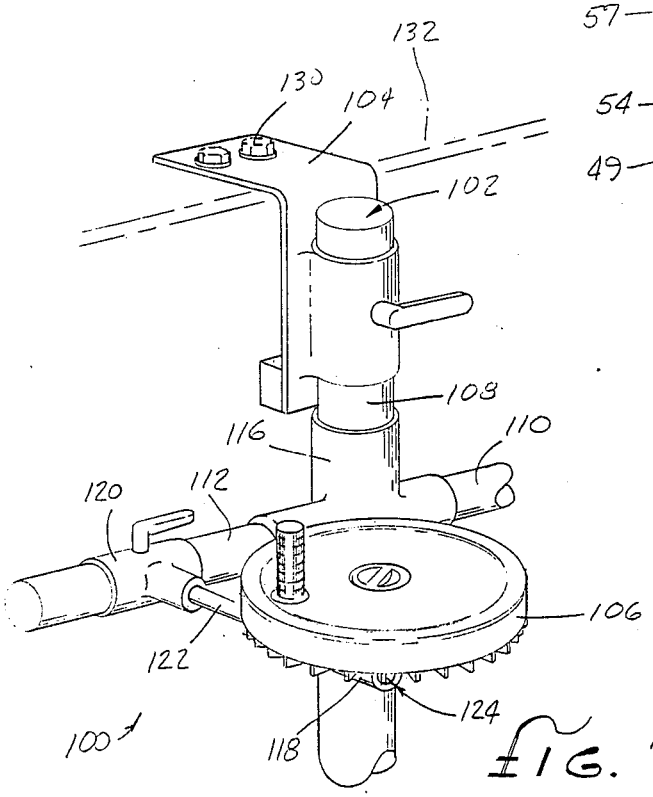
FIG. 7 is a perspective view of a second embodiment of the invention.

A second embodiment of the invention is illustrated in FIG. 7. This embodiment differs from the prior embodiment in the framing by which the disc assemblies 14 are carried. In the second embodiment, the device 100 is adapted to be secured to the side of a swimming pool as opposed to a free standing frame.

Exercising device 100 comprises a frame 102, a pair of frame securement brackets 104, and a pair of disc assemblies 106. Due to the symmetry of the device 100, FIG. 7 illustrates only the left half thereof. It is to be understood that a second disc assembly, securement bracket and related support bars and arms identical to those shown in FIG. 7 are merely spaced laterally to the right of those shown in the drawing and are interconnected by support bar 110.

The disc assemblies 106 employed in the second embodiment are identical to the disc assemblies 14 in the prior embodiment. The left half of frame 102, as seen in FIG. 7, comprises a vertical support bar 108 carried by the securement bracket 104, horizontal support bars 110 and 112 which are adjustably secured to the vertical support bar 108 by means of a four-way coupling 116. A T-coupling 120 is adjustably mounted on support bar 112 for supporting extension rod 122. Extension rod 122 extends from sleeve 118 disposed under the disc assembly 106 and is secured to the disc assembly ball joint 124 just as the disc assemblies 14 are supported by rods 36, sleeves 37 and ball joints 44 in the prior embodiment. Ball joints 124 an identical in their construction and operation to the ball joints 44 of the prior embodiment.

The right side of the exercising device 100 not shown in FIG. 7 is identical to the above-described left side with the second four-way coupling (not shown) being secured to the support bar 110, the second vertical support bar extending upwardly therefrom to the second securement bracket and the second disc assembly 106 being mounted off a horizontal support bar identical to 112 by means of a second T-coupling identical to 120.

The functioning, adjustment and operation of the disc assemblies 106 is the same as the disc assemblies 14 in the prior embodiment, except that each assembly is preferably mounted on separate vertical support bars 108 in lieu of the single support member 20 in the prior embodiment. The securement brackets 104 are provided with suitable means such as screws 130 for affixing the brackets to deck 132 of side of the pool.

Through the aforesaid configuration, the disc assemblies 106 can be oriented in the desired positions as in the prior embodiment. It is to be understood that frame 102, just as frame 12, and the means for adjusting the component elements thereof could be configured in several different ways and provide the necessary adjustability of the disc assemblies. These and other modifications and changes could be made in carrying out the present invention. Insofar as these changes and modification are within the purview of the appended claims, they are to be considered as part of the present invention.

I claim:

1. A variable resistance underwater exercising device comprising a support structure, a pair of support arms carried by said support structure, a pair of blade assemblies carried by said support arms and means for adjusting the orientation of said blade assemblies with respect to said support structure, each of said blade assemblies including a rotatably mounted support element, a handle member secured to said support element for manual rotation thereof, a plurality of blades carried by said support element for rotation therewith, a shroud disposed about at least a portion of said blades, means for allowing fluid flow through said shroud, and means for collectively varying the angular orientation of said blades with respect to said support element to vary the resistance of the water on the blades upon the blades being rotated underwater by said handle member.

2. A variable resistance underwater exercising device comprising a support structure, a pair of support arms carried by said support structure, a pair of disc assemblies carried by said support arms and means for adjusting the orientation of said disc assemblies with respect to said support structure, each of said disc assemblies including a rotatably mounted disc, a handle member secured to said disc, a plurality of blades carried by said disc for rotation therewith, a shroud disposed about at least a portion of said blades, means for allowing fluid flow through said shroud, and means for collectively varying the angular orientation of said blades with respect to said disc to vary the resistance of the water on the blades upon the blades being rotated under water by said handle member.

3. A variable resistance underwater exercising device comprising a support structure, a pair of support arms carried by said support structure, a pair of disc assemblies carried by said support arms and means for adjusting the orientation of said disc assemblies with respect to said support structure, each of said disc assemblies including a rotatably mounted disc, a handle member secured to said disc, a plurality of blades carried by said disc for rotation therewith and means for varying the angular orientation of said blades with respect to said disc to vary the resistance of the water on the blades upon the blades being rotated under water by said handle member, said means comprising a primary gear member, a plurality of secondary gear members, each of said secondary gear members being carried by one of said blades and engaging said primary gear member and means for rotating said primary gear member with respect to said disc for rotating said secondary gear members and varying the angular orientation of said blades with respect to said disc.

4. The combination of claim 3 wherein said orientation adjusting means comprises a bracket means slidably mounted on said support structure, a horizontal support bar carried by said bracket means, said support arms being carried by said bar, means for securing said bracket means to said support structure at a desired location thereon, means for adjustably rotating at least a portion of said support arms with respect to said support bar about a first axis, and means for adjustably pivoting said disc assemblies with respect to said support arms about a second axis, said second axis being perpendicularly disposed with respect to said first axis.

5. A variable resistance underwater exercising device comprising a support structure, a pair of support arms adjustably mounted on said support structure, and a pair of disc assemblies adjustably mounted on said support arms, each of said disc assemblies comprising disc rotatably mounted thereon, a handle member secured to said disc for manual rotation of said disc, a plurality of blades carried by said disc and rotatable therewith, an annular wall disposed about said blades, said wall defining a plurality of apertures therein, a bottom plate member defining a plurality of apertures therein and means for collectively varying the angular orientation of said blades with respect to said disc.

6. The combination of claim 5 wherein said means for varying the angular orientation of said blades comprises a primary gear member, a plurality of secondary gear members, each of said secondary gear members being carried by one of said blades and engaging said primary gear member and means for rotating said primary gear member with respect to said disc for rotating said secondary gear members and varying the angular orientation of said blades with respect to said disc.

7. The combination of claim 6 including a horizontal support bar, said support arms being carried by said support bar, a bracket means secured to and extending between said support structure and said support bar, said bracket being slidable along said support structure, releasable means for securing said bracket and said support arms to said support structure at a desired height thereon, means for adjustably rotating at least a portion of said support arms with respect to said support bar, and means disposed between said support arms and said disc assemblies for pivotally mounting said disc assemblies to said support arms such that the axes of rotation of said discs can be selectively fixed in varying orientations with respect to said support structure.

8. A variable resistance underwater exercising device comprising a support structure defining a base member and a vertical support member, a horizontal support bar, a pair of support arms carried by said support bar, a bracket slidably mounted on said support member, releasable means for securing said bracket to said support member at a desired height thereon, a pair of disc assemblies, and means for pivotally mounting said disc assemblies on said support means, each of said disc assemblies comprising a rotatably mounted disc, a handle member secured to said disc, a plurality of blades carried by said discs for rotation therewith and means for varying the angular orientation of said blades with respect to said discs to vary the resistance of the water on the blades upon the blades being rotated under water by said handles.

9. A variable resistance underwater exercising device comprising a support structure and a pair of disc assemblies carried by said support structure, each of said disc assemblies comprising a disc rotatably mounted on said assembly, a handle member secured to said disc for manual rotation of said disc, a plurality of blades carried by said discs and rotatable therewith, an annular wall disposed about said blades, said wall defining a plurality of apertures therein, a bottom plate defining a plurality of apertures therein and means for collectively varying the annular orientation of said blades with respect to said discs and means for adjustably mounting said disc assemblies on said support structure such that the axes of rotation of said disc assemblies can bed selectively varied.

10. The combination of claim 8 wherein said varying means comprises a primary gear member, a plurality of secondary gear members, each of said secondary gear members being carried by one of said blades and engaging said primary gear member and means for rotating said primary gear member with respect to said disc for rotating said secondary gear members and varying the angular orientation of said blades with respect to said disc.

11. The combination of claim 9 wherein said varying means comprises a primary gear member, a plurality of secondary gear members, each of said secondary gear members being carried by one of said blades and engaging said primary gear member and means for rotating said primary gear member with respect to said disc for rotating said secondary gear members and varying the angular orientation of said blades with respect to said disc.

* * * * *